US006681963B2

(12) United States Patent
Hague et al.

(10) Patent No.: US 6,681,963 B2
(45) Date of Patent: Jan. 27, 2004

(54) APPARATUS FOR DISPENSING RINSE WATER ADDITIVE IN AN AUTOMATIC WASHING MACHINE

(75) Inventors: Philip Edwin Hague, Chicago, IL (US); Michelle Lynn Moorman, Kings Mills, OH (US); Naomi Ruth Nelson, Cincinnati, OH (US); Timothy Frederik Thomas Perry, London (GB); Alton Warren Clark, Jr., Sharonville, OH (US); Bradley Wayne Daubenspeck, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/126,898

(22) Filed: Apr. 19, 2002

(65) Prior Publication Data

US 2003/0000972 A1 Jan. 2, 2003

Related U.S. Application Data

(60) Provisional application No. 60/285,818, filed on Apr. 23, 2001.

(51) Int. Cl.[7] ..... B65D 5/72

(52) U.S. Cl. ..... 222/500; 222/463; 222/158; 68/17 R; 68/207

(58) Field of Search ..... 222/463, 500, 222/158; 68/17 R, 207

(56) References Cited

U.S. PATENT DOCUMENTS

| | | | |
|---|---|---|---|
| 2,956,709 | A | 10/1960 | Nison et al. |
| 3,044,665 | A | 7/1962 | Ludwig et al. |
| 3,095,722 | A | 7/1963 | Fox |
| 3,108,722 | A | 10/1963 | Torongo, Jr. et al. |
| 3,180,538 | A | 4/1965 | Brown et al. |
| 3,215,311 | A | 11/1965 | Nison et al. |
| 3,661,299 | A | 5/1972 | Durstewitz |
| 3,888,391 | A | 6/1975 | Merz |
| T993,001 | I4 | 4/1980 | McCarthy |
| 4,656,844 | A | 4/1987 | Mulder et al. |
| 4,703,872 | A | 11/1987 | Cornette et al. |
| 4,835,804 | A | 6/1989 | Arnau-Munoz et al. |
| 4,875,600 | A | 10/1989 | D'Hoogue et al. |
| 4,893,726 | A | 1/1990 | Vesborg |
| 4,915,267 | A | 4/1990 | Buecheler et al. |
| 4,942,973 | A | 7/1990 | Bowie |
| 4,944,165 | A | 7/1990 | Leebeek et al. |

(List continued on next page.)

*Primary Examiner*—Kevin Shaver
*Assistant Examiner*—Stephanie Willatt
(74) *Attorney, Agent, or Firm*—Jason J. Camp; Kim W. Zerby; Steven W. Miller

(57) ABSTRACT

A rinse water additive dispenser for use in an automatic washing machine is disclosed. The dispenser includes a top, a valve assembly and a base releasably connected to the top. The valve assembly is retained within a valve housing located in the top and is able to move within the housing. The valve assembly includes a resilient disk valve and counterweight that are interconnected by a valve post. The resilient valve is located, enclosed, or compressed between the top and base portions when the top and base are connected. The top and base can be connected with threads, tongue and groove structures etc. When subjected to the centrifugal force of a spin cycle, the movement of the counterweight within the device causes the resilient disk to unseat from between the top and base allowing fluid communication between the dispenser and the tub of the washing machine. Optionally, the dispenser can have an elliptical cross section to promote proper orientation of the dispenser during the spin and rinse cycles. Further, a protective material can be affixed to the outer surfaces of the top and base portions of the dispenser.

19 Claims, 7 Drawing Sheets

U.S. PATENT DOCUMENTS 4,969,927 A 11/1990 Schumann et al.
4,982,467 A 1/1991 Mizusawa et al.
5,033,643 A 7/1991 Schumacher
5,129,120 A 7/1992 Cornette et al.
5,267,671 A 12/1993 Baginski et al.
5,314,098 A 5/1994 Milenkevich
5,355,541 A 10/1994 Rutter et al.
5,358,152 A 10/1994 Banks
5,388,298 A 2/1995 Rutter et al.
5,768,918 A 6/1998 McKibben
5,978,994 A 11/1999 Anderson

APPARATUS FOR DISPENSING RINSE WATER ADDITIVE IN AN AUTOMATIC WASHING MACHINE

CROSS REFERENCE TO RELATED APPLICATIONS

This application claims priority under 35 U.S.C. §119(e) to U.S. Provisional Application Ser. No. 60/285,818, filed Apr. 23, 2001.

TECHNICAL FIELD

The present relation relates to an improved method and apparatus for dispensing a rinse water additive in an automatic washing machine.

The present invention further relates to such a method and apparatus which is especially suited to highly concentrated rinse water additives which are added in relatively small volume, thereby making accurate measurement and avoidance of leakage during the wash cycle critical to obtaining the desired benefits to be provided by the additive during the rinse cycle.

The present invention has further relation to such a method and apparatus wherein the center of gravity of the apparatus and the rinse water additive fluid contained therein is maintained in such position that rinse water is readily able to enter and exit the dispenser during the rinse cycle after the dispensing valve has been opened, thereby ensuring that all of the rinse water additive initially provided in the dispenser is fully utilized during the rinse cycle.

BACKGROUND OF THE INVENTION

Dosing dispensers for the addition of laundering and softening materials during the washing and rinsing cycles in an automatic washing machine are well known in the art.

Dispensers for adding materials during the rinse cycle in an automatic washer are generally more complex than those employed for adding materials during the wash cycle due to the fact that the rinse additive dispenser is normally inserted when the wash cycle begins and must survive the entire wash cycle without dispensing the material contained inside, yet reliably open during the spin cycle at the conclusion of the wash cycle to deliver the rinse water additive at a point in time which will be effective.

One prior art example of such a rinse water additive dispenser is disclosed in commonly assigned U.S. Pat. No. 3,888,391 issued to Merz on Jun. 10, 1975 and hereby incorporated herein by reference.

Another example of such a prior art rinse water additive dispenser is disclosed in U.S. Defensive Publication No. T993,001 to McCarthy, which was published on Apr. 1, 1980, and which is hereby incorporated herein by reference. Similar examples are found in U.S. Pat. No. 5,267,671, issued to Baginski et al. on Dec. 7, 1993 and U.S. Pat. No. 5,768,918 issued to McKibben on Jun. 23, 1998, both of which are incorporated herein by reference.

Dispensers of the aforementioned type employ a valve means which is automatically opened by centrifugal forces acting upon a counterweight during the spin cycle at the conclusion of the wash operation. After the spin cycle, dispensers of the aforementioned type fall from the wall of the washing machine drum and rinse water floods the dispenser, mixing with and dispensing the additive into the rinse water.

While dispensers of the aforementioned type have functioned adequately for their intended purpose with prior art rinse water additives, trends in the development of more effective rinse water additives have been in the direction of more highly concentrated products which deliver comparable performance benefits to the less concentrated products which they are tending to replace. Typical rinse additive dispensers are generally spherical in shape and employ a fill mark to indicate when the desired amount of additive has been poured into the dispenser. When the volume of product to be added is quite small, accurate measurement thereof is difficult to achieve with prior art style dispensers, namely because even a slight deviation from the fill mark represents a substantial change in product volume. (More specifically, the cross-section of the sphere increases rapidly in the area of the fill mark so that slight deviations from the fill mark represent substantial deviations in the amount of product actually included within the dispenser, particularly if the user overshoots the fill mark. Further, many of the prior art dispensers have a counterweight that cannot be removed during filling and hangs in the device while filling, thereby blocking the filling orifice of the device (and making it more difficult to measure amounts of additives). The counterweight may also skew the volume determination because depending on where the counterweight is stationed during filling, the amount of product measured may be greater or lesser than intended, i.e., the counterweight occupies volume during filling that may or may not translate to the occupied volume anticipated by the fill marks.

An additional problem associated with the prior art dispensing devices is that it is commonly difficult to properly seat the valve means prior to the placement of the dispenser in the washing machine. When not properly seated, these valves tend to either dislodge prematurely during the wash cycle where rinse water additives give ineffective and unsatisfactory results or fail to open at all. An additional problem associated with these devices is that the valve means is commonly not removable from the internal chamber. In such a design, the valve means is an obstacle that interferes with the introduction of rinse water additive into the dispenser leading to spillage and waste.

Accordingly, it is an object of the present invention to provide an improved method and apparatus that makes accurate measurement of the laundry additive into the dispenser relatively easy for the user.

It is another object of the present invention to provide a dispensing apparatus having an improved valve seal design and improved valve assembly design that simplifies the proper seating of the valve means. It is still another object of the present invention to provide a dispensing apparatus having an improved design that will provide an unobstructed opening through which the dispenser may be filled with rinse water additives and easily measured. Protection against premature opening is extremely important for rinse additive dispensers, since premature opening of the dispenser during the wash cycle will most likely result in complete loss of the additive during the wash cycle.

It is still another object of the present invention to provide such an improved rinse additive dispenser which will maintain the center of gravity of the dispenser and the additive contained therein in a position that will ensure the ability of the rinse water to enter and exit the dispenser through the filling/dispensing aperture of the dispenser once the valve used to close the filling/dispensing aperture has moved to its open position to effectively utilize all of the rinse additive originally placed within the dispenser.

SUMMARY OF THE INVENTION

The present invention provides a rinse water additive dispenser comprising, a top enclosing a valve housing and at least one opening to allow fluid communication between the valve housing and external environment, a valve assembly that is retained within the valve housing, said valve assembly comprising a resilient valve and counterweight, and a base releasably connected to the top, said base having walls that define an internal chamber for containing a rinse water additive and an opening for receiving the additive and counterweight. The valve assembly has freedom to move within the housing between open and closed positions.

In an additional aspect of the present invention, the resilient valve is located, enclosed, or compressed between the top and base portions of the dispenser when the valve assembly is in the closed position, thereby preventing fluid communication between the internal chamber, the valve housing and the washing machine tub.

In a further aspect of the present invention, dispenser has retaining means for retaining the valve assembly within the valve housing. When the top portion of the dispenser is removed from the base, the attached valve assembly lifts out of the internal chamber. The resilient valve and counterweight of the valve assembly are interconnected by a post that extends through the resilient valve and into the valve housing. The valve housing has a retaining member having an opening through which the upper portion of the post extends. The terminal end of the post has a flange extending radially from the post. Because this flange is too large to pass through the opening of the retaining member the valve assembly is prevented from sliding out of the valve housing. Optionally, the valve post may be telescoping to allow the valve assembly to drop further into the internal chamber.

In a further aspect of the present invention, the valve assembly may include tapered geometry above the counterweight and below the valve in order to assist in proper alignment of the valve along the edge of the internal chamber. This tapered geometry is wider near the valve and narrower near the counterweight, thus helping to properly seat the valve. Optionally, the tapered geometry is formed from (a) a separate part surrounding the counterweight stem between the bottom of the valve and the counterweight and/or (b) the manufacture of the counterweight in such geometry. Optionally, the counterweight stem is cork shaped.

In yet a further aspect of the present invention, the top and base portions of the dispensing device are releasably connected by threads or tongue and groove structures on the top and base portions respectively.

In still yet a further aspect of the invention, the dispensing device will have a generally elliptical cross sectional shape to promote the proper orientation of the device. Likewise, the counterweight may have the same general shape. In addition, it is another aspect of the present invention, that the dispensing device has a protective material of at least a portion of the exterior surfaces of the top and base portions of the device. In addition, it is another aspect of the present invention, that the base portion of the dispensing device may be constructed from one part or from two or more parts that are connected by a snap or tongue-in-grove-feature. The snap feature may be a square undercut snap.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

FIG. 1 is a cross sectional view of the device of FIG. 3*a* taken along line A–A'.

DETAILED DESCRIPTION OF THE INVENTION

Figure 1:
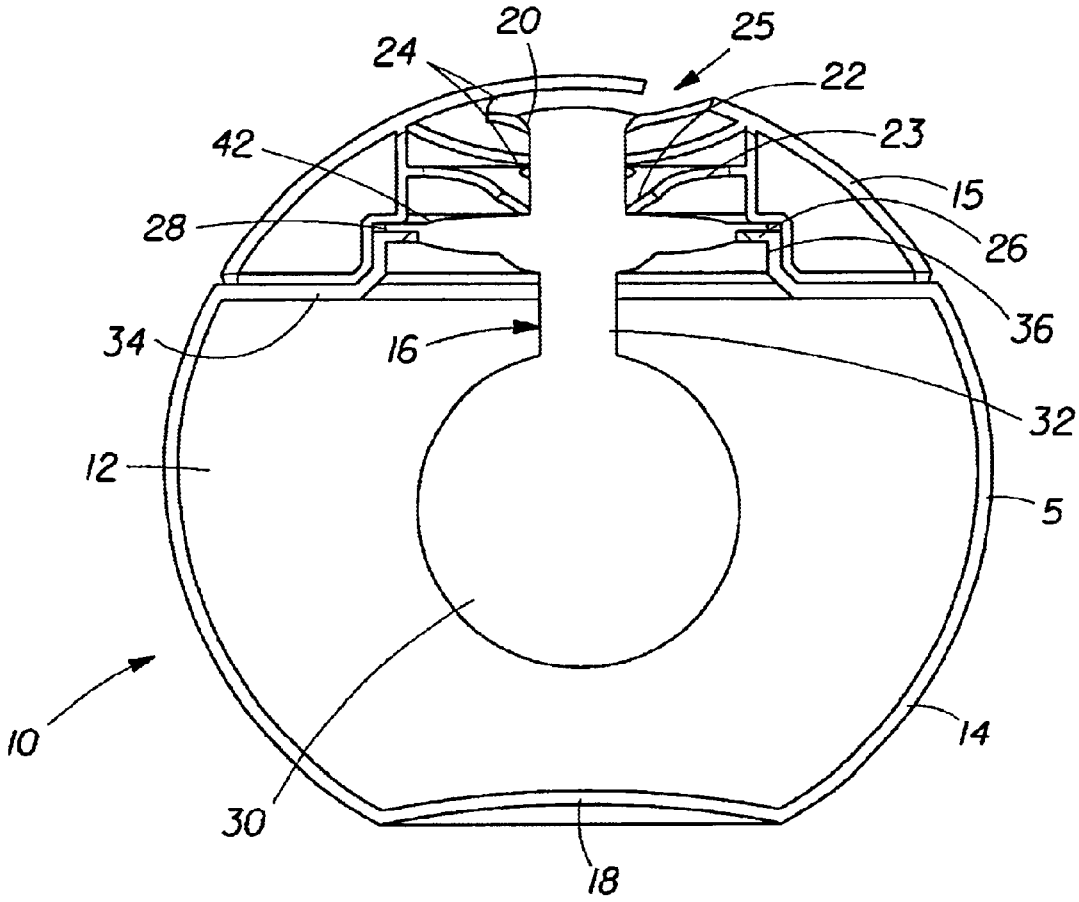
FIG. 1 is a cross sectional view of a dispensing device of the present invention that illustrates the valve assembly in a closed configuration.

Referring now to the Drawings, and more particularly to FIG. 1, there is shown a preferred embodiment of the present invention, generally indicated as 10, illustrated in a closed configuration. The rinse water additive dispenser of the present invention comprises three main elements, top 15 that defines or encloses a valve housing, valve assembly 16 that is retained within the valve housing but which is free to move therein, and base 5.

The Base

Base 5 is comprised of sidewalls 14, bottom wall 18, and upper wall 34. Rising from upper wall 34 is neck 36 that defines annular opening 38. Neck 36 is further provided with an upwardly facing surface, upper surface 26. The side, bottom and upper walls of base 5 define internal chamber 12 that holds the rinse water additive until the valve assembly is actuated. Although internal chamber 12 is defined within the confines of base 5, in alternative embodiments, top 15 may define the upper parameters of the internal chamber. However, as illustrated in drawings and as described in this preferred embodiment, internal chamber is defined within the confined of base 5.

The normal dose of a fluid rinse water additive to be included within the dispenser is at least 25 ml, preferably at least 30 ml, more preferably at least 55 ml. Further, while described in terms of a fluid rinse water additive, the dispenser of the present invention may also be used to dispense any flowable rinse water additive in an automatic washing machine. Fill marks may be included on the device to indicate the normal dosage. A preferred device has fill marks at the 30 ml and 55 ml location.

Base sidewalls 14 may range from about 0.03 to about 0.2, preferably from about 0.05 to about 0.15 inches thick and can be made of a material such as clarified polypropylene. The sidewalls may vary in thickness throughout. More preferably, sidewalls 14 will be made of any polymeric materials that will provide sufficient strength to the dispensing device that it will withstand repeated wash cycles in an automatic washing machine. In addition, it is preferred that the material of sidewalls 14 be translucent or even transparent to enable the user to view the additive that is being introduced into the device and accurately measure the additive for dispensing. It is anticipated that only a portion of sidewalls 14 may have such light transmission capability. Optional fill marks may be included on the device by varying the transparency of the material.

Figure 3A:
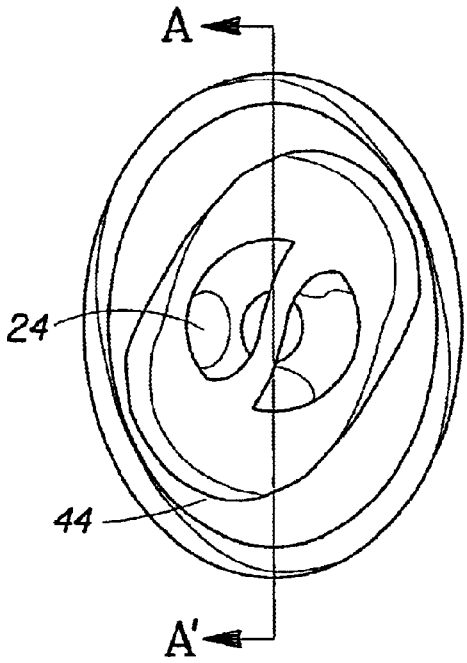
FIG. 3*a* is an elevated view of the top and base of a dispensing device of the present invention illustrating the shape of the dispensing device.

Sidewalls 14 can be shaped to have any shape desired. As noted herein, common prior art devices have a cylindrical barrel-like shape or are spherical in nature. However, the preferred shape of the dispensing devices of the present invention is a rounded disc shape that has an oval or more preferably an elliptical cross sectional shape. As described below in additional detail, it has been found that this rounded disc or "M&M" shape tends to provide improved orientation of the device in the washing machine. When this preferred shape is used, it is preferred that the diameter of the disc, as measured along line A–A' of FIG. 3*a*, range from about 2 inches to about 5 inches depending on the volume of additive that is desired to be dispensed with the device.

Neck 36 has upper surface 26 measuring at least 1 inch in diameter, preferably from about 1.5 to 2 inches in diameter, and including a filling/dispensing opening 38 that measures at least 0.75 inches, preferably from about 1 to about 1.75 inches in diameter, centered on the axis of the dispenser. Neck 36 can have an internal cylindrical or tubular shape that measures from about 0.01 to about 0.5 inches in length, preferably from about 0.1 to about 0.4 inches in length. Base 5 can be made of a material such as polypropylene plastic by an injection molding process of the type well known in the art. Base 5 can be made by stretch blow molding, injection molding and other molding processes that are well known in the art.

It is also preferred that Base 5 have protective material 44 over at least a portion of the outer surface of sidewalls 14. The purpose of protective material 44 is to protect the dispensing device, the washing machine components and the fabrics in the washing machine from any damage that might otherwise occur during the agitation and spin cycles of an automated washing machine. Preferably, protective material 44 is a thermoplastic material that may be molded and subsequently affixed to the outer surface of sidewalls 14. As noted, protective material may be applied to the whole of the outer surfaces of the top and base portions of the device or applied to only portions of these surfaces to enhance the aesthetics of the dispensing device.

The Top

As noted above, top 15 contains or encloses valve housing 25. The top is provided with openings 24 to allow fluid communication between the valve housing and the environment external to the dispensing device. When the valve assembly is properly seated in a closed configuration, water can enter the valve housing but it is not able to enter and mix with the rinse water additive(s) in the internal chamber 12. Once valve assemble 16 has been actuated by the centrifugal forces of the spin cycle, the unseated valve allows for fluid communication between the internal chamber 12 and valve housing 25. It is this path that allows water to enter the internal chamber containing the rinse water additive, mix with the additive and to dispense the additive during the rinse cycle.

Top 15 has an undersurface that complements or mates with the outer surface of upper wall 34. More specifically, top 15 has undersurface 28 that is adjacent upper surface 26 of neck 36. The top and base portions of the dispenser are formed so that surfaces 26 and 28 are set apart slightly to provide a slight gap there between. Resilient disk valve 42, described in more detail below, is located, enclosed within, or compressed in the gap between surfaces 26 and 28 to seal opening 38. During the spin cycle, the centrifugal forces acting on the valve assembly cause resilient disc valve 42 to be dislodged from this gap allowing the valve assembly to partially drop into internal chamber 12.

Within valve housing 25 is internally extending retaining member 23. Retaining member 23 has an annular opening for receiving valve post 32 of the valve assembly and an upper surface 22 about that annular opening.

Figure 3B:
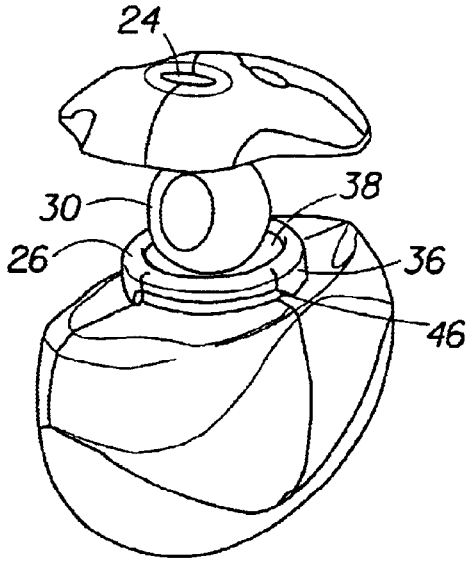
FIG. 3*b* is a perspective view of dispensing device shown in FIG. 3*a* that illustrates the unsecured top being lifted from the base and the tongue and groove structures that releasably secure the top to the base.

Top 15 further has means for releasable connecting the top to base 5. This connection means is not illustrated in FIG. 1., but is illustrated in FIG. 3*b* as tongue and groove structures. As shown, a groove 40 is formed in neck 36 of base 5. The tongue portion formed on the underside of top 15 is not visible in FIG. 3*b*. Similarly not visible is one or more additional sets of tongue and groove structures that can be used to secure top 15 to base 5. In operation, the top is easily secured to the base by aligning the tongues in the grooves and rotating the top relative the base until it stops, preferably between about 45° and 180°. Whatever means are used to releasably secure the top and base portions of the device, it is most preferred that the device include means to prevent the two portions from being compressed together too tightly as such may interfere with the ability of valve assembly 16 to dislodge when desired. For example, where the top and base portions are releasably connected by threads, it is preferred that the device have means to prevent to over-rotation of such threads.

The Valve Assembly

Valve assembly 16 in the preferred embodiment comprises resilient valve 42, counterweight 30 and valve post 32 interconnecting the resilient valve and counterweight. In FIG. 1, valve assembly 16 is shown seated above chamber 12. Assembly 16 has a preferably rigid weight 30 and rigid or semi-rigid post 32. At the terminal end of post 32, opposite weight 30, is flange 20 extending radially outward from the post.

Resilient valve 42 is preferably a disk valve that is slightly deformable. Resilient disc valve 42 is preferably connected to post 32 by means of a groove formed in post 32 that engages a hole in disk 42, preferably by means of an interference fit. Adhesive may also be used to adhere disk valve 42 to post 32. Disk valve 42 seats between neck upper surface 26 and undersurface 28. Upper surface 26 and undersurface 28 compressively hold disk valve 42 in a closed position over opening 38 until the spin cycle of the washing machine takes place. The seal thus formed prevents water from entering or additive from exiting chamber 12 through opening 38. Resilient valve 42 can be made of Shore A 58 durometer polyisoprene elastomer by an injection molding process of the type well known in the art. Alternatively, natural rubber can be compression molded to form valve 42. Other types of elastomers may also be used in the construction of disk valve 42.

Figure 4A:
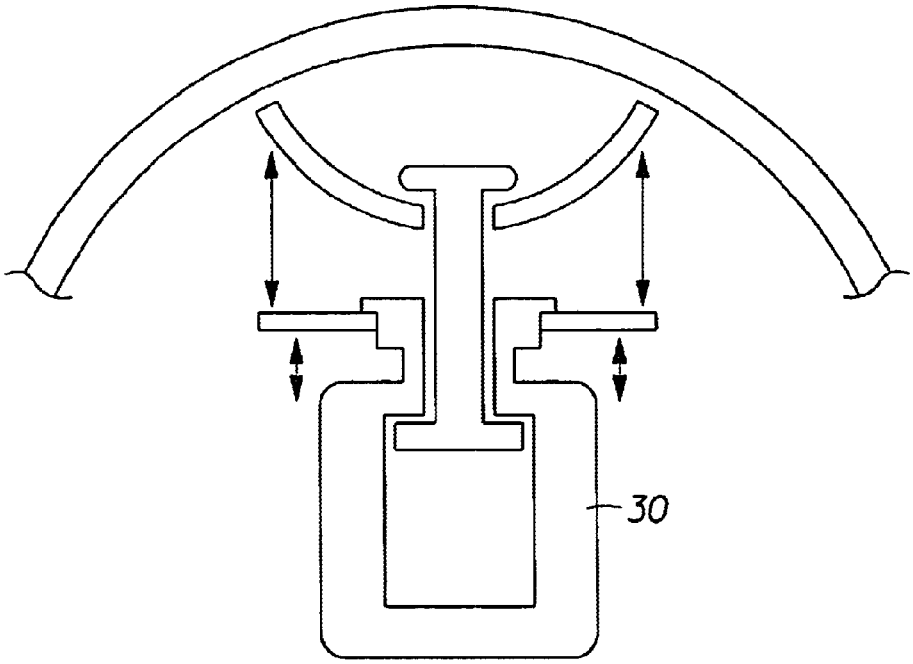
FIGS. 4*a* and 4*b* are partial cross sectional views of the valve housing and valve assembly that illustrate optional telescoping valve means.
Figure 4B:
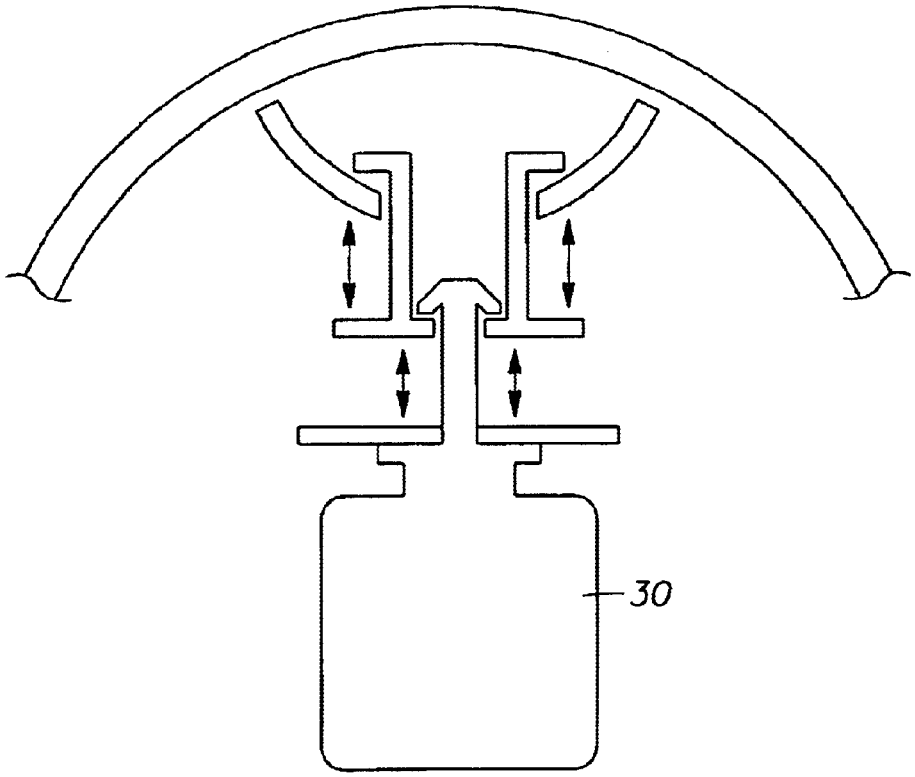
Figure 5A:
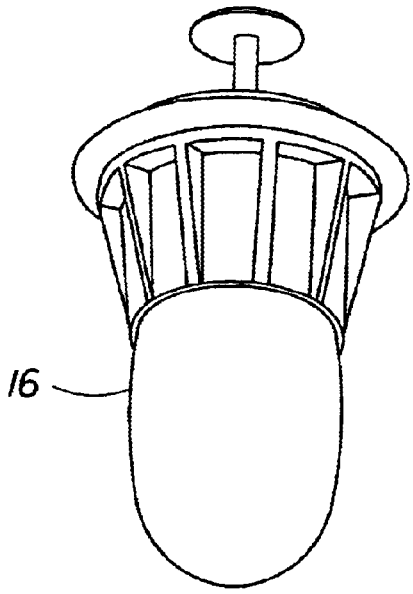
FIGS. 5*a* and 5*b* are perspective views of the valve assembly that illustrates a tapered geometry between the valve and the counterweight. The tapered geometry illustrated here is formed by providing a tapered collar in between the weight and the bottom of the valve.
Figure 5B:
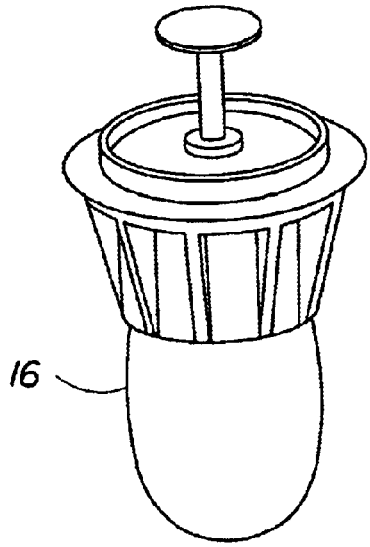
Figure 6:
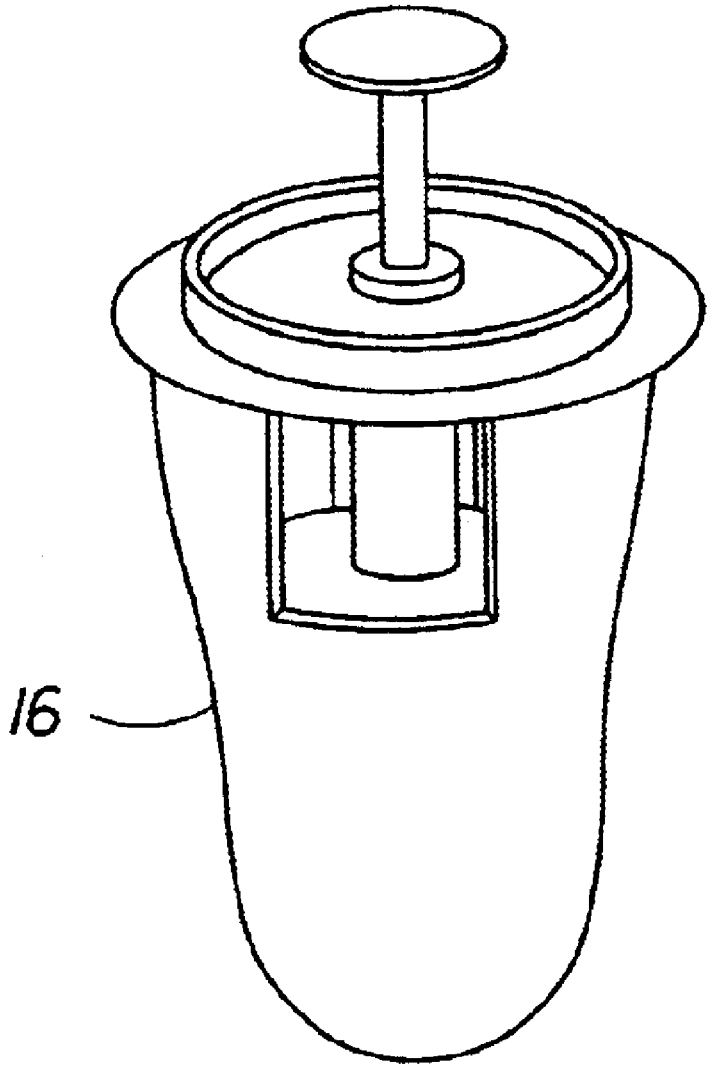
FIG. 6 is a perspective view of the valve assembly that illustrates a tapered geometry between the valve and the counterweight. The tapered geometry illustrated here is formed by incorporating the geometry into the weight design.
Figure 7:
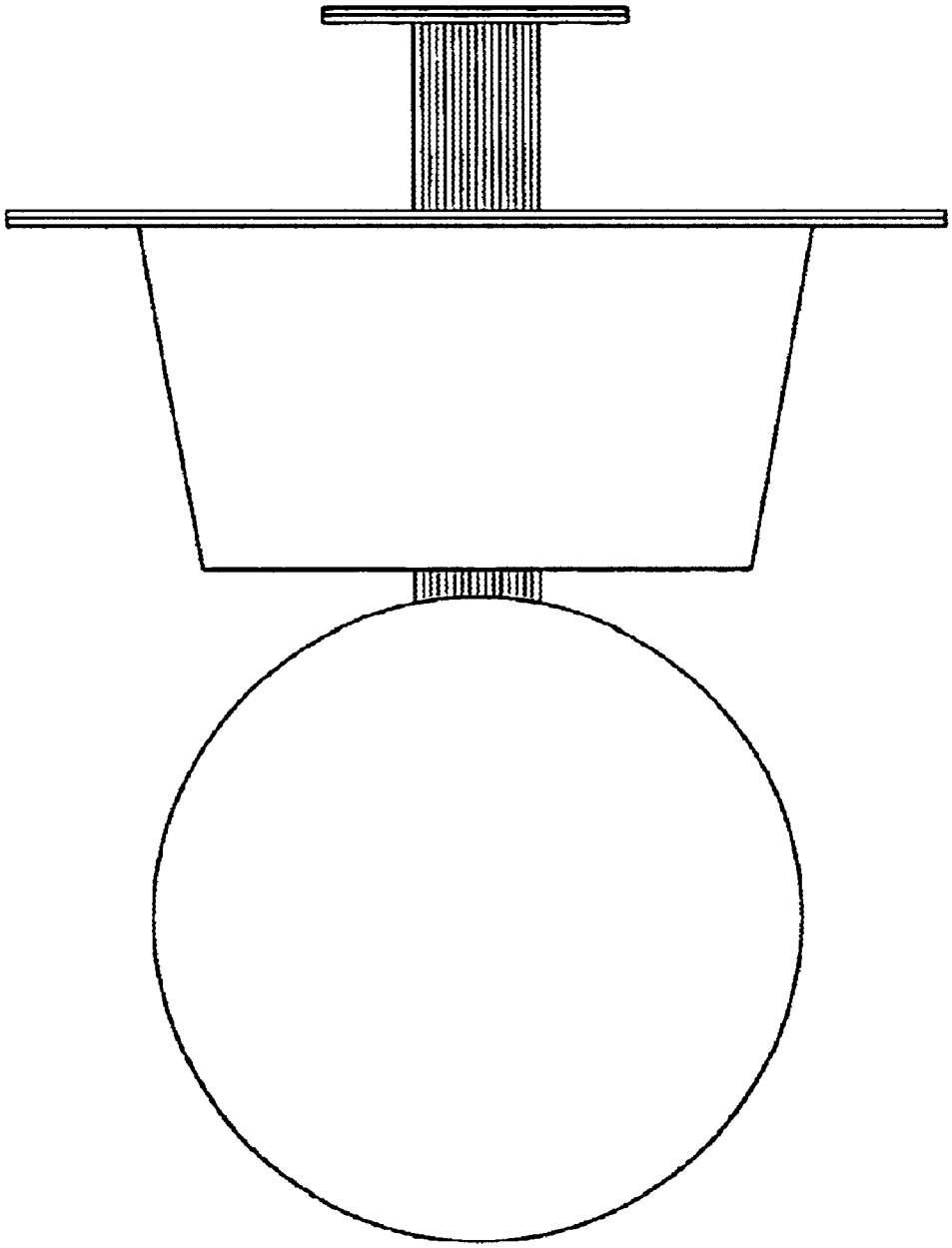
FIG. 7 is a cross sectional view of a valve assembly that illustrates a tapered geometry between the valve and the counterweight.

Post 32 is preferably molded using an acetal resin such as Delrin via an injection molding process of the type well known in the art. Counterweight 30 is preferably molded using barium sulfate filled polypropylene. Alternatively, weight 30 and post 32 may comprise materials such as resins, metals, e.g., aluminum, substantially rigid plastics (e.g., molded polypropylene) and combinations thereof. Optionally, rather than having solid post 32, it may be preferred that post 32 be telescoping such as is illustrated in FIGS. 4*a* and 4*b*. Having a telescoping valve post can enable the construction of dispensing devices that have a smaller top and valve housing elements and a larger base and internal chamber. Optionally, the post 32 may have a tapered geometry in-between the bottom of valve 42 and the top of counterweight 30 as illustrated in FIGS. 5*a*, 5*b*, 6, and 7.

Counterweight 30 is preferably molded in an open condition and thereafter closed about the post 32 after the attachment of disk valve 42. Counterweight 30 may be molded into a simple spherical shape but will preferably have a shape that mimics the shape of the overall dispenser. For instance, as illustrated in FIG. 3*b*, the dispenser has a rounded disc shape and counterweight 30 is spherical but with substantially flat portions on opposite sides to simulate the elliptical cross section of the device.

Counterweight 30 preferably weighs from about 15 to about 45 grams and is positioned so that its center is located approximately 1.25 inches from the center of valve assembly 16, such that the centrifugal acceleration typically experienced in a washing machine spin cycle will dislodge resilient disk valve 42 from between surfaces 26 and 28. Of course, the weight and location of counterweight 30 may be altered as needed to insure that the centrifugal forces generated in the spin cycle are sufficient to dislodge disk valve 42.

Seating and Actuation of the Valve Assembly

Figure 2A:
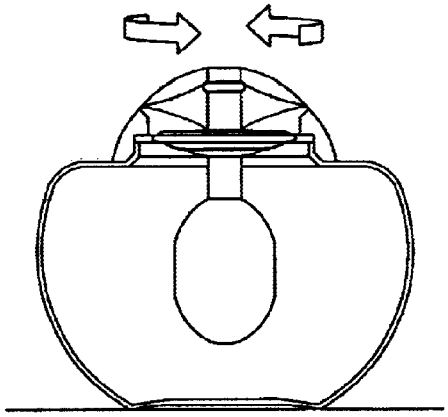
FIG. 2*a* is a cross sectional view of the dispenser in FIG. 1 that indicates the direction of rotation for releasing the top from the base
Figure 2B:
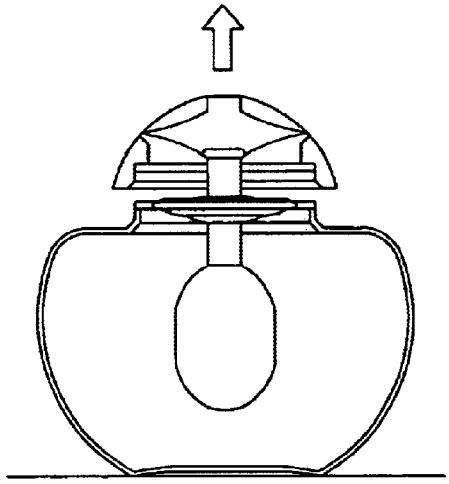
FIG. 2*b* is a cross sectional view of the dispenser in FIG. 2*a* that indicates the movement of valve assembly as the unsecured top is lifted from the base.
Figure 2C:
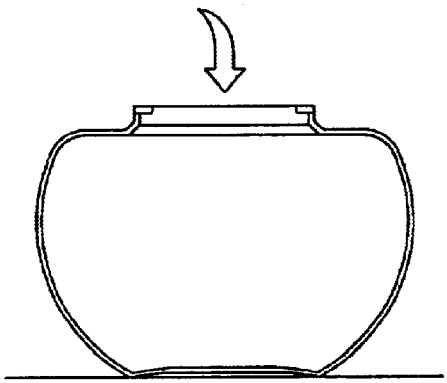
FIG. 2*c* is a cross sectional view of base of FIG. 2*b* with the top and valve assembly removed.

FIGS. 2*a*–2*d* provide an illustration of the removal of top 15 and the seating of the valve assembly 16 during use. As shown in FIG. 2*a*, the dispensing device of the present invention is upright on bottom wall 18, valve assembly 16 is shown in a closed configuration and top 15 is secured to base 5. The top is then rotated 90° counter clockwise relative to the base to disengage it from the base. As shown in FIG. 2*b*, the top may then be lifted from the base. As top 15 is lifted, the valve assembly and post 32 slides down through the opening in retaining member 23 until flange 20 engages with annular surface 22. The valve assembly then lifts out and away from base opening 38 and both the top and valve assembly may be set aside while the base is filled with a desired rinse water additive. The ability to fill internal chamber 12 without any obstruction in opening 38, as shown in FIG. 2*c*, is highly desirable. Any flowable rinse water additive may be introduced into internal chamber 12 with significantly reduced risk of spillage or waste.

Figure 2D:
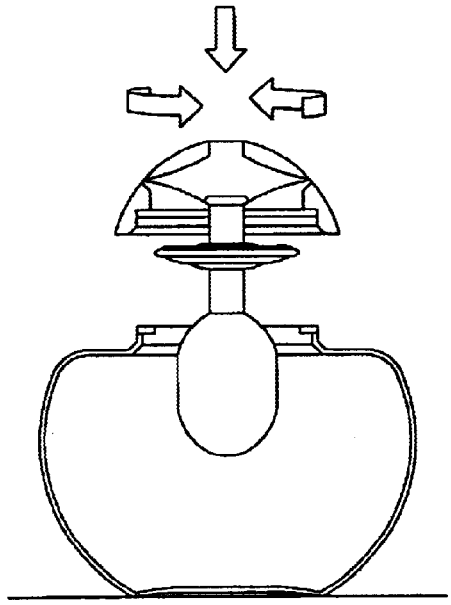
FIG. 2*d* is a cross sectional view of base indicating the direction of rotation for simultaneously seating the valve means and securing the top to the base.

Once filled with the desired additive, the top and valve assembly are reattached to base 5. As illustrated in FIG. 2*d*, counterweight 30 is inserted opening 38 and allowed to partially hang down into internal chamber 12. The tongue element on top 15 is aligned with groove 40 as the top is lowered onto the base. The underside of resilient valve 42 contacts and rests on upper surface 26. The valve assembly and post 32 then slide up into the valve housing within top 15. The undersurface 28 of the top then comes into contact with the upper surface of valve 42. Continued downward pressure locates, encloses, or compresses the resilient valve between surfaces 26 and 28 to provide a seal over base opening 38. To maintain the pressure on the valve and lock it in place, the top is then rotated 90° clockwise relative to the base.

As noted above, dispenser 10 preferably has a rounded disc shape not unlike that of M&M® candy available from the Mars Corporation. As noted in FIG. 3*a*, this shape gives the device an oval or elliptical cross sectional shape. When the dispenser has this shape, its most stable orientation is at rest on a wide portion of sidewall 14, generally parallel to line A–A'. While in this orientation during the spin cycle, the centrifugal force of the spinning drum acts on counterweight 30 to generate a bending moment at valve 42 causing it to dislodge from between surfaces 26 and 28. The bending moment required to open the valve 42 is relatively predictable as a function of drum RPM.

After the spin cycle has been completed, the centrifugal force of the spin cycle has opened the valve and the rinse water enters the drum. When rinse water fills the washer drum, it is desirable for the dispenser 10 become substantially flooded. For maximum effectiveness, it is believed to be most desirable for dispenser 10 to remain close to a substantially horizontal condition so that it can fill as much as possible with rinse water and so that turbulence of the rinse cycle agitation will pull it under to help flush the additive out of the dispenser. After rinse water has flushed the additive from the dispenser, and the final machine cycle is completed, the dispenser may be removed from the washer drum and drained of water so that it may be refilled for the next wash load.

While particular embodiments of the present invention have been illustrated and described, it will be obvious to those skilled in the art that various changes and modifications can be made without departing from the spirit and scope of the invention, and it is intended to cover in the appended claims all such modifications that are within the scope of this invention.

What is claimed is:

1. A rinse water additive dispenser comprising a top enclosing a valve housing and at least one opening to allow fluid communication between the valve housing and external environment;

a valve assembly that is retained within the valve housing, said valve assembly comprising a resilient valve and counterweight; and a base releasably connected to the top, said base having walls that define an internal chamber for containing a rinse water additive and an opening for receiving the additive and counterweight, whereby releasably connecting the base to the top seats the resilient valve on the base opening.

2. The dispenser of claim 1, wherein said valve assembly is allowed to move between closed and open positions.

3. The dispenser of claim 1, wherein the resilient valve is a disk valve having a diameter that is greater than the base opening.

4. The dispenser of claim 1, wherein when the valve assembly is in the closed position, the resilient valve is located between the top and base preventing fluid communication between the internal chamber and the valve housing.

5. The dispenser of claim 1, wherein the resilient valve and counterweight are interconnected by a post, said post having an upper portion that extends beyond the resilient valve into the valve housing.

6. The dispenser of claim 5, wherein the valve housing has a retaining member having an opening through which the upper portion of the post extends.

7. The dispenser of claim 6, wherein the upper portion of the post has a flange extending from the post, said flange having a dimension greater than the opening of the retaining member.

8. The dispenser of claim 1, wherein the resilient valve and counterweight are interconnected by a post having telescoping means.

9. The dispenser of claim 1, wherein the top and base have threads for releasably connecting the top and base and means to prevent over rotation of said threads.

10. The dispenser of claim 1, wherein the top and base have a tongue and groove for releasably connecting the top and base.

11. The dispenser of claim 1, wherein the base has an elliptical cross section.

12. The dispenser of claim 1, wherein the top has an elliptical cross section.

13. The dispenser of claim 1, wherein the base has means for enabling the viewing of a rinse water additive in the internal chamber.

14. The dispenser of claim 1, wherein the base further comprises a protective material affixed to at least a portion of the base.

15. The dispenser of claim 1, wherein the base further comprises a protective material affixed to at least a portion of the top.

16. The dispenser of claim 1, wherein the counterweight and the base have similar cross sectional shapes.

17. The dispenser of claim 1, wherein the valve assembly comprises tapered geometry between the counterweight and the bottom of the valve.

18. The dispenser of claim 17, wherein the tapered geometry is formed by the manufacture of the counterweight.

19. The dispenser of claim 1, wherein the base is formed from two or more parts which are connected together by means selected from the group consisting of snaps, tongue-in-groove, and combinations thereof.

* * * * *